United States Patent [19]

Cha et al.

[11] Patent Number: 4,470,526

[45] Date of Patent: Sep. 11, 1984

[54] SIPHON DISPENSING BOTTLE

[76] Inventors: Jungkeun Cha, c/o George Spector, 3615 Woolworth Bldg., 233 Broadway, New York, N.Y. 10007; George Spector, c/o Jungkeun Cha, 3615 Woolworth Bldg., 233 Broadway, New York, N.Y. 10007

[21] Appl. No.: 291,302

[22] Filed: Aug. 10, 1981

[51] Int. Cl.[3] ..... B05B 9/043

[52] U.S. Cl. ..... 222/320; 222/377; 222/383; 222/564; 222/575

[58] Field of Search ..... 222/320, 321, 382, 383, 222/464, 547, 564, 211, 212, 377, 405, 575; 137/140, 142, 152

[56] References Cited

U.S. PATENT DOCUMENTS

| | | | |
|---|---|---|---|
| 222,140 | 12/1879 | Lindsay | 222/405 X |
| 1,410,878 | 2/1921 | Benshoof | 222/377 X |
| 2,066,040 | 12/1936 | Kee | 222/575 X |
| 2,657,826 | 11/1953 | Ludowitz | 222/564 X |
| 3,113,698 | 12/1963 | Abplanalp | 222/402.18 X |
| 3,501,067 | 3/1970 | Rigor | 222/464 |
| 4,220,285 | 9/1980 | Gualdi | 222/383 X |

FOREIGN PATENT DOCUMENTS

| | | | |
|---|---|---|---|
| 371010 | 5/1939 | Italy | 222/320 |

*Primary Examiner*—Robert B. Reeves
*Assistant Examiner*—Russell D. Stormer

[57] ABSTRACT

A dispensing container having a sloped bottom wall, into a lowermost portion of which, a feed tube is extended and connects to a dispensing spout on a top of the container, and the feed tube in one design thereof including a conical fitting in a flared lower end thereof for controlling flow therethrough, and in another design the tube including a floatation member to sufficiently lift the tube lower end off the bottom wall so to allow entry of dispensing material thereinto.

1 Claim, 5 Drawing Figures

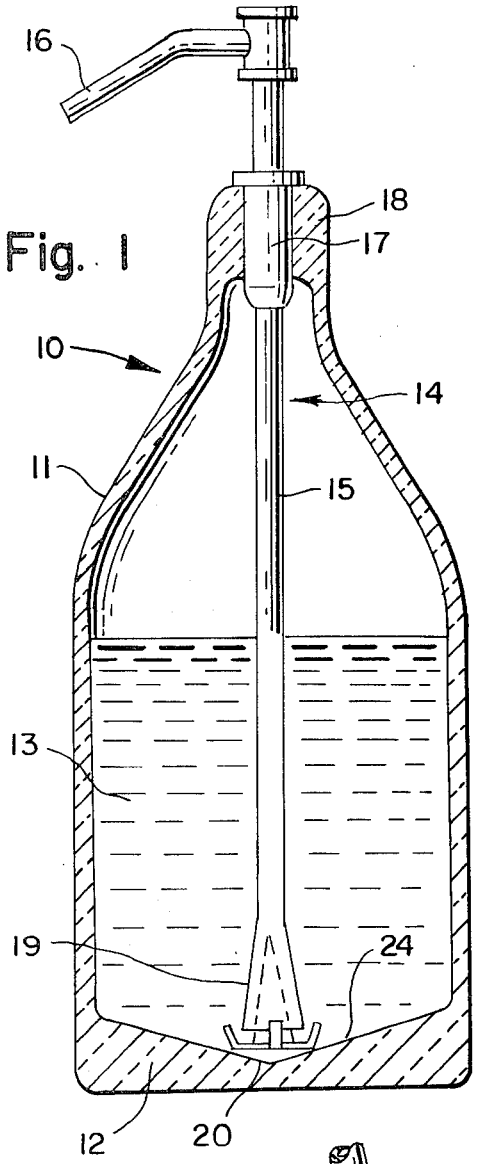
Fig. 1
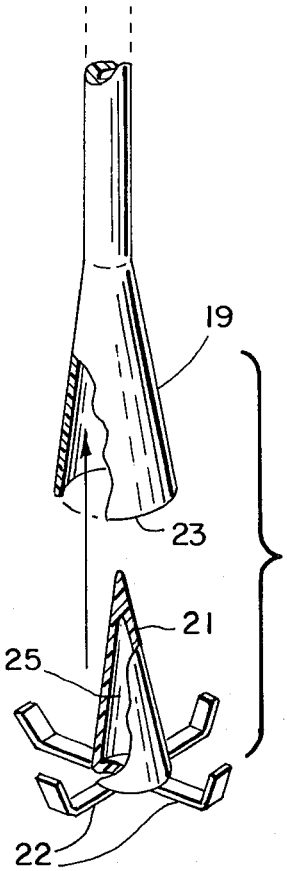
Fig. 2
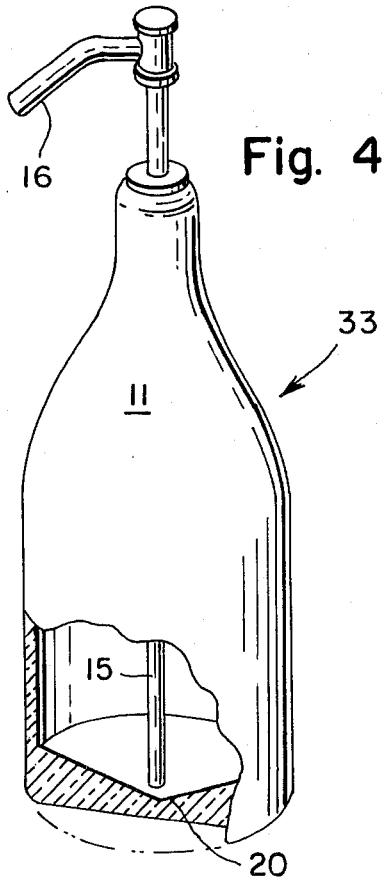
Fig. 4
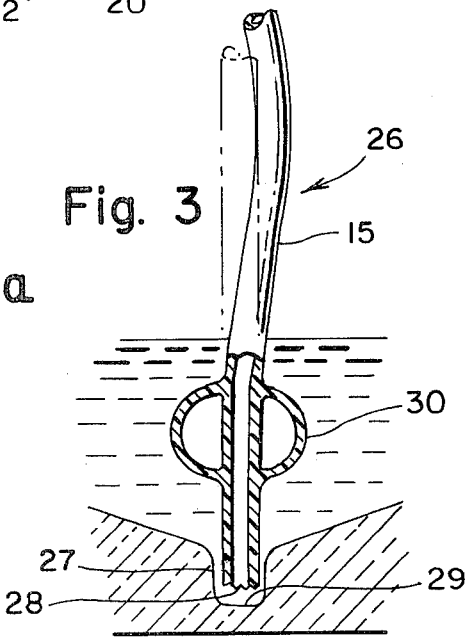
Fig. 3
Fig. 3a
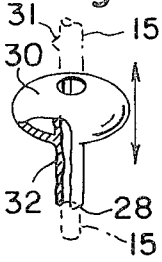

SIPHON DISPENSING BOTTLE

This invention relates generally to dispensing bottles having feed tube syphons therein.

It is well known that conventional dispensing bottles do not completely dispense all of a liquid contained therein, and when the bottle no longer is able to dispense any more of its content, it is regarded as empty, and is discarded, even thouugh a little of its original content still remains in the bottom of the bottle. This is wasteful, so that this situation is therefore in need of an improvement.

Accordingly, it is a principal object of the present invention, to provide a dispensing container having a sloped bottom wall, so that even a small amount of the content, remaining therein, by being collected at a small part of its bottom, is thus sufficiently deep so that the dispensing mechanism of the container can still reach, pick it up and dispense out of the container.

Another object accordingly is to provide a sloped bottom, dispensing container which by preventing waste of its content, thus saves money by not requiring so soon another purchase of a new replacement for the apparently empty dispensing container.

FIG. 1 is a cross sectional view of a sloped bottom bottle, showing one design of the invention.

FIG. 2 is an enlarged perspective view of the straw shown in FIG. 1.

FIG. 3 is an enlarged cross sectional view of another design thereof wherein the straw goes in a hole at the apex of the sloped bottom so as to additionally feed every drop.

FIG. 3A shows a variation of the straw structure shown in FIG. 3.

FIG. 4 shows still another design of sloped bottom bottle.

Referring now to the drawing in greater detail, and more particularly to FIGS. 1 and 2 thereof, at this time, the reference numeral 10 represents a dispensing container according to the present invention, which comprises a bottol 11 having a sloped bottom wall 12 that has its upper surface downwardly tapered either conically toward its center, as shown, or else inclined toward one end, not shown, so that a last of a liquid content 13 of the bottle is thus collected to a greater depth for being reached by a despensing machanism 14 in order to be yet dispensed.

The mechanism 14 includes a flexible plastic tube 15 which at its upper end is connected to a dispensing spout 16 located above a fitting 17 of the tube fitted leak proof in or on the neck 18 of the bottle. A lower end 19 of the tube extends into the lower position or apex 20 of the bottom wall. The tube lower end is made outwardly flared so that a conical fitting 21 fits therein loosely, the fitting including four radially extending feet 22 which rest on the bottom wall 12. Thus a lower edge 23 of the tube may rest upon the feet and allows a space between the lower edge 23 and the top surface 24 of the bottom wall in order that the liquid has access to enter the tube. The conical fitting is made hollow with a central air space 25, and is molded together with its feet from a light weight plastic, so to float and thus slightly lift the lower end of the tube, except at such time when only a small quantity of the liquid is left in the apex 20.

Referring now to FIGS. 3 and 3A, another design 26 of the invention, includes a narrow downward hole 27 in the apex 20 of the bottom wall, the hole being only very slightly larger in diameter than the lower end 19 of the tube so that the same loosely fits thereinto. The lower edge 23 of the tube is provided with a row of V-shaped notaches 28 so that even if the edge 23 abuts a bottom wall 29 of the hole, then the liquid may still flow into the tube. A spherical, hollow collar 30 is formed around a lower portion of the tube, the collar containing sealed air in order to tend to float, and thus lift the tube edge 23 off the hole bottom wall 29, the plastic tube being sufficiently flexible so to thus lift the tube lower end but being rigid enough so that the tube's lower end is in dislodged outward from the hole 27. The collar in FIG. 3*a* is freely slidable around the tube up to a stop 31, and includes a stem 32 therwith that has the notches 28.

Referring now to FIG. 4, a simple design 33 of the invention consists in a plain lower end of the tube extending into the apex 20 and being slightly spaced from the bottom wall so to permit entry of the liquid into the tube.

While various changes may be in the detail construction, it is understood that such changes will be within the spirit and scope of the present invention as is defined by the appended claims.

What is claimed:

1. A liquid dispensing container comprising in combination a bottle having a sloped portion, a dispensing mechanism in said bottle including a flexible tube connected at its upper end to a fitting at a neck of said bottle and which includes a dispensing spout, and a lower end of said tube having an intake opening extending into a lower end of said sloped portion, including a floatation device projecting within said lower end of said tube urging said tube lower end upward and permitting liquid flow through said intake opening with said tube lower end submerged adjacent said sloped portion when sufficient liquid is in said bottle to cause flotation of said device, including means at said tube lower end providing liquid access to said intake opening when the liquid level is below said floatation device wherein said tube lower end is flared and said device comprises a conical loosely fitting member disposed in said flared lower end of said tube whereby when said member moves downward, more space is exposed between said lower tube end and said member for liquid flow, wherein said means further includes feet extending from said member for engaging said lower tube end.

* * * * *